US007905101B2

(12) United States Patent
Sunderland et al.

(10) Patent No.: US 7,905,101 B2
(45) Date of Patent: Mar. 15, 2011

(54) REFRIGERATED MERCHANDISER WITH GLASS DOOR HEAT CONTROL

(75) Inventors: Ted Wayne Sunderland, Troy, MO (US); Craig Steven Reichert, St. Charles, MO (US); Dennis L. Dickerson, O'Fallon, MO (US)

(73) Assignee: Hussmann Corporation, Bridgeton, MO (US)

( * ) Notice: Subject to any disclaimer, the term of this patent is extended or adjusted under 35 U.S.C. 154(b) by 614 days.

(21) Appl. No.: 11/957,043

(22) Filed: Dec. 14, 2007

(65) Prior Publication Data

US 2008/0141689 A1 Jun. 19, 2008

Related U.S. Application Data

(60) Provisional application No. 60/870,152, filed on Dec. 15, 2006.

(51) Int. Cl.
*F25D 21/00* (2006.01)

(52) U.S. Cl. ..... 62/150; 62/151; 62/248

(58) Field of Classification Search ..... 62/151, 62/150, 155, 157, 248; 165/231–233
See application file for complete search history.

(56) References Cited

U.S. PATENT DOCUMENTS 3,859,502 A * 1/1975 Heaney ..... 219/218
3,911,245 A * 10/1975 O'Shaughnessy ..... 219/218
4,260,876 A * 4/1981 Hochheiser ..... 219/497
4,261,179 A * 4/1981 Dageford ..... 62/150
4,745,629 A * 5/1988 Essig et al. ..... 377/20
5,778,689 A * 7/1998 Beatenbough ..... 62/150
6,144,017 A * 11/2000 Millett et al. ..... 219/522
6,653,606 B1 * 11/2003 Son et al. ..... 219/522
6,722,142 B1 * 4/2004 Pagel ..... 62/131
7,137,262 B2 * 11/2006 Carter ..... 62/150
7,207,181 B2 * 4/2007 Murray et al. ..... 62/150
7,240,501 B2 * 7/2007 Bunch et al. ..... 62/150
2005/0172649 A1 * 8/2005 Bunch et al. ..... 62/154

OTHER PUBLICATIONS

Sensirion SHT1x/SHT7x Humidity & Temperature Sensor, v2.04, 9 pages, as early as May 2005.

* cited by examiner

*Primary Examiner* — George Nguyen
(74) *Attorney, Agent, or Firm* — Michael Best & Friedrich LLP

(57) ABSTRACT

A method of operating a refrigerated merchandiser. The refrigerated merchandiser includes a case that defines a product display area, and at least one door that provides access to the product display area. The method includes sensing a parameter of an ambient environment adjacent the case, delivering a signal indicative of the sensed parameter to a controller, and determining a duty cycle using the controller based on the signal indicative of the sensed parameter. The method also includes detecting a change in the sensed parameter using the controller, interrupting the duty cycle by initiating a clearing interval using the controller in response to the controller receiving the signal indicative of the change in the sensed parameter, and clearing condensation from the door during the clearing interval.

14 Claims, 5 Drawing Sheets

REFRIGERATED MERCHANDISER WITH GLASS DOOR HEAT CONTROL

RELATED APPLICATIONS

This patent application claims priority to U.S. Patent Application Ser. No. 60/870,152, filed Dec. 15, 2006, the entire contents of which are hereby incorporated by reference.

BACKGROUND

The present invention relates to a control system for a refrigerated merchandiser that heats a glass door of the merchandiser to eliminate condensation on the glass door. More particularly, the present invention relates to a control system for a refrigerated merchandiser that initiates a heating process for a glass door of a refrigerated merchandiser using a controller in response to a change in a position of the glass door.

Existing refrigerated merchandisers display fresh and frozen food product in a product display area, and include glass doors to provide visibility of the food product and product accessibility to consumers. Often, condensed moisture accumulates on the exterior surface of the cold glass, which obscures viewing of the product in the merchandiser. The moisture in the relatively warm ambient air of the store can condense on the outside surface of the glass door. Similarly, moisture can condense on the cold inside surface of the glass door when the door is opened. Without heating, the condensation on the outside and inside of the glass door does not clear quickly and obscures the food product in the merchandiser. Long periods of obscured food product caused by condensation may detrimentally impact sales of the food product.

Some glass doors include a resistive coating or semi-conductive film (e.g., tin-oxide) adhered or affixed to the glass door to remove condensation and fog. The resistive coating supplies heat to the glass door via current flow through the coating caused by a supply of electrical potential or electricity from the merchandiser. Typically, the heat applied to the glass door is controlled by a controller based on a duty cycle. These duty cycles are varied between an "on" state (i.e., heat applied to the glass door) and "off" state to regulate the time that heat is applied to the glass door, and are generally defined by the percentage of time that the duty cycle is in the "on" state.

Some merchandisers employ a knob or other manual control that can be used by an operator to set the percentage of time that the duty cycle is in the "on" state based on the experience of the operator. Other existing merchandisers include a sensor to sense parameters of the ambient environment surrounding the merchandiser (e.g., humidity, temperature). A controller is in electrical communication with the sensor, and determines a duty cycle to remove condensation from the glass door based on the sensed parameters.

Typically, sensors of conventional control systems are attached to the merchandiser at a relatively large distance from the glass door and the refrigerated product display area (e.g., on an exterior wall of the merchandiser, on a wall adjacent the merchandiser) to avoid an adverse impact on the sensed parameters caused by infiltration of relatively cold, dry air when the glass door is opened. However, placement of conventional sensors at relatively long distances from the glass door limits the effectiveness of the sensor to accurately measure ambient conditions adjacent the glass door. As a result, the duty cycle determined by the controller may not be adequate to clear the glass door because insufficient heat may be supplied by the resistive coating. Insufficient heat applied to the glass door can cause poor dissipation of condensation and fog. Similarly, inaccurate measurements by the sensor may cause the controller to supply too much heat to the glass door, resulting in increased energy costs.

Existing control systems regulate heat applied to glass doors based on a predetermined duty cycle. These control systems supply electrical potential to the glass door based on the predetermined time that the duty cycle is in the "on" state. The time that the duty cycle is in the "on" state is regulated to limit energy use by the merchandiser. Once the duty cycle enters the "off" state, no electrical potential is supplied to the glass door. When the glass door is opened during the predetermined time that the duty cycle is in the "off" state, condensation may readily form on the interior and/or exterior of the glass door.

Conventional control systems cannot eliminate condensation that forms on the glass door when the duty cycle is in the "off" state. Instead, heat is applied to the glass door to remove condensation only when the duty cycle is in the "on" state. As such, the duty cycle regulated by conventional control systems can adversely affect elimination of condensation from the glass door due to a relatively long period of time between the glass door being opened and the duty cycle entering the "on" state. The inability of existing control systems to actively remove condensation from glass doors in response to formation of condensation allows condensation to remain on the glass doors for a long time, and detrimentally impacts the viewability of the food product.

Similarly, conventional control systems cannot compensate for multiple door openings that occur in a relatively short period of time to adequately clear condensation and fog from the glass doors. For example, when multiple door openings occur and the duty cycle is in the "off" state (i.e., no heat applied to the glass door), condensation can accumulate on the glass door. The condensation is not removed by the control system until the duty cycle enters the "on" state. Depending on the duty cycle, a relatively long period of time can elapse between the last of the multiple door openings and entry of the duty cycle into the "on" state. As a result, the glass door can remain obscured by condensation for a relatively long time.

SUMMARY

In one embodiment, the invention provides a method of operating a refrigerated merchandiser that includes a case that defines a product display area, and at least one door that provides access to the product display area. The method includes sensing a parameter of an ambient environment adjacent the case, delivering a signal indicative of the sensed parameter to a controller, and determining a duty cycle using the controller based on the signal indicative of the sensed parameter. The method also includes detecting a change in the sensed parameter using the controller, interrupting the duty cycle by initiating a clearing interval using the controller in response to the controller receiving the signal indicative of the change in the sensed parameter, and clearing condensation from the door during the clearing interval.

In another embodiment, the invention provides a method of operating a refrigerated merchandiser that includes a case that defines a product display area, and at least one door that provides access to the product display area. The method includes sensing a parameter of an ambient environment adjacent the case, determining a duty cycle using the controller based on the signal indicative of the sensed parameter, detecting the occurrence of a door event of the door in response to the door moving between a first position to a second position, interrupting the duty cycle by initiating a clearing interval using the controller in response to the door event, and clearing condensation from the door during the clearing interval.

In yet another embodiment, the invention provides a refrigerated merchandiser that includes a case and at least one door coupled to the case. The case defines a product display area and includes a casing that has at least one mullion defining an opening that is in communication with the product display area. The door provides access to the product display area and substantially encloses the product display area, and includes a glass member that has a conductive film. The refrigerated merchandiser also includes at least one sensor and a controller. The sensor is positioned adjacent the door, and is in communication with the opening to detect a door event of the door and to generate a signal indicative of the door event. The controller is in communication with the sensor to receive a signal indicative of the door event from the sensor, and is further in communication with the conductive film to initiate a clearing interval to clear condensation from the door in response to the signal indicative of the door event.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
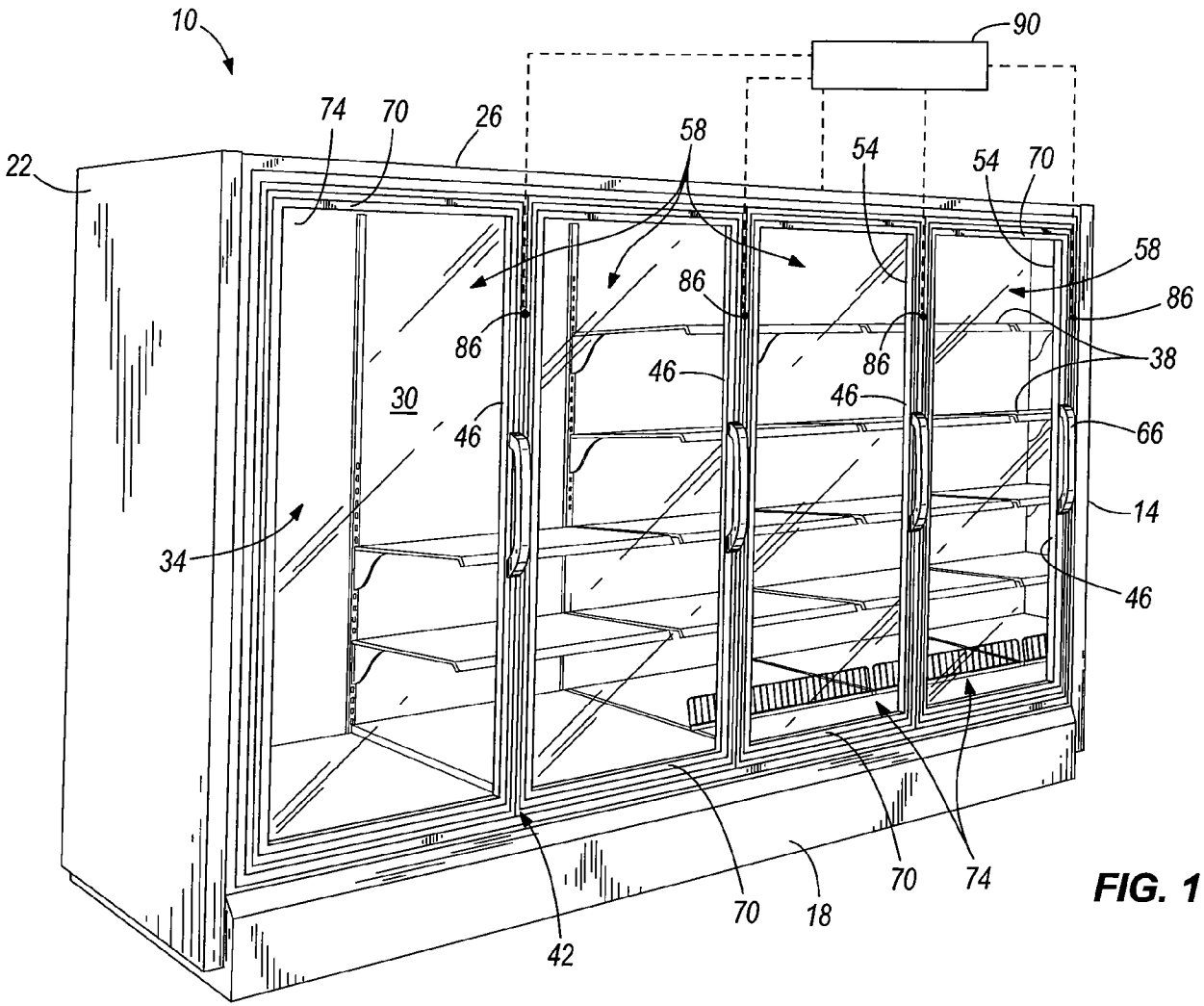
FIG. 1 is a perspective view of an exemplary refrigerated merchandiser that includes a plurality of doors and a control system.

FIG. 1 shows a refrigerated merchandiser 10 for displaying food product (not shown) available to consumers in a retail setting (e.g., a supermarket or grocery store). The refrigerated merchandiser 10 includes a case 14 that has a base 18, side walls 22, a case top 26, and a rear wall 30. At least a portion of a refrigeration system (not shown) can be located within the case 14 to refrigerate the food product. The area partially enclosed by the base 18, the side walls 22, the case top 26, and the rear wall 30 defines a product display area 34. The food product is supported on shelves 38 within the product display area 34.

Figure 2:
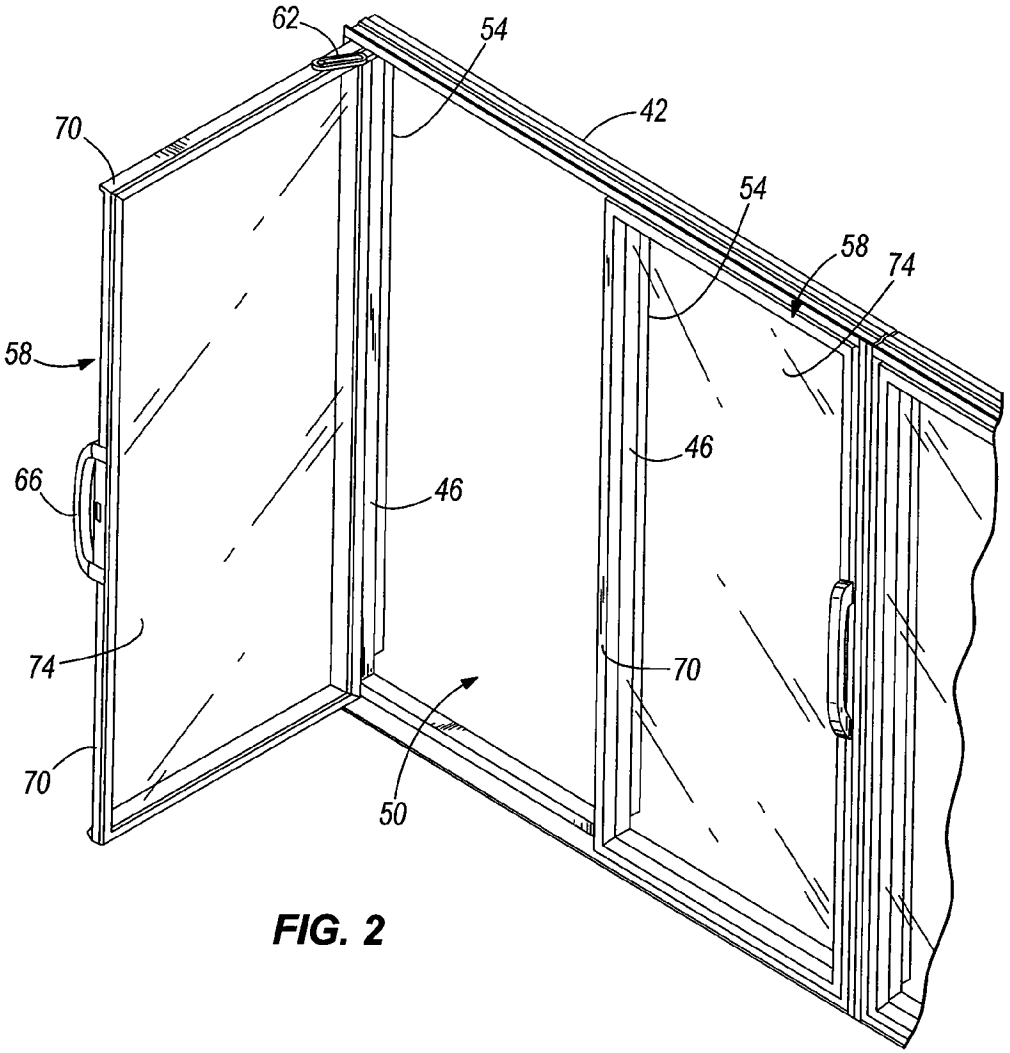
FIG. 2 is a perspective view of the doors and a casing of the refrigerated merchandiser of FIG. 1.
Figure 3:
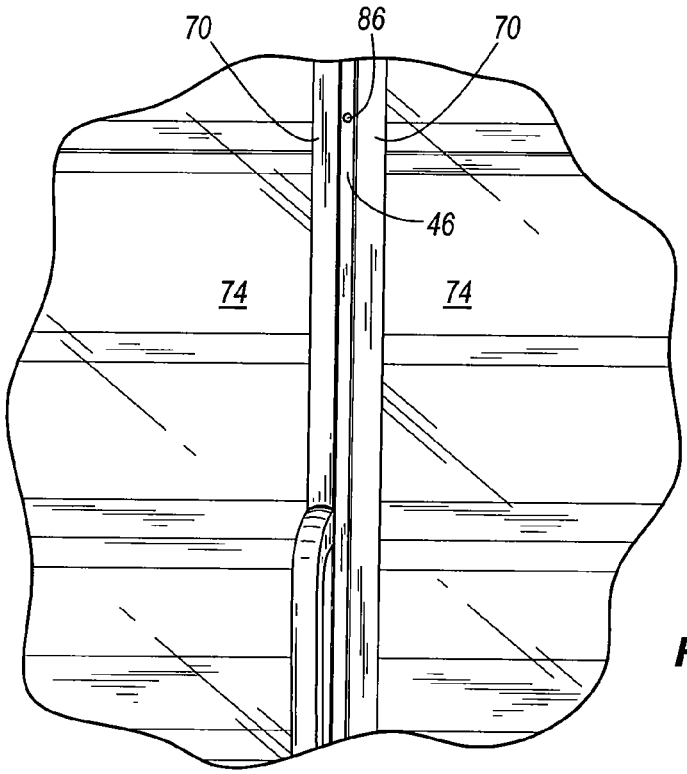
FIG. 3 is an enlarged front view of the refrigerated merchandiser of FIG. 1, including a sensor of the control system coupled to the casing adjacent a closed door.
Figure 4:
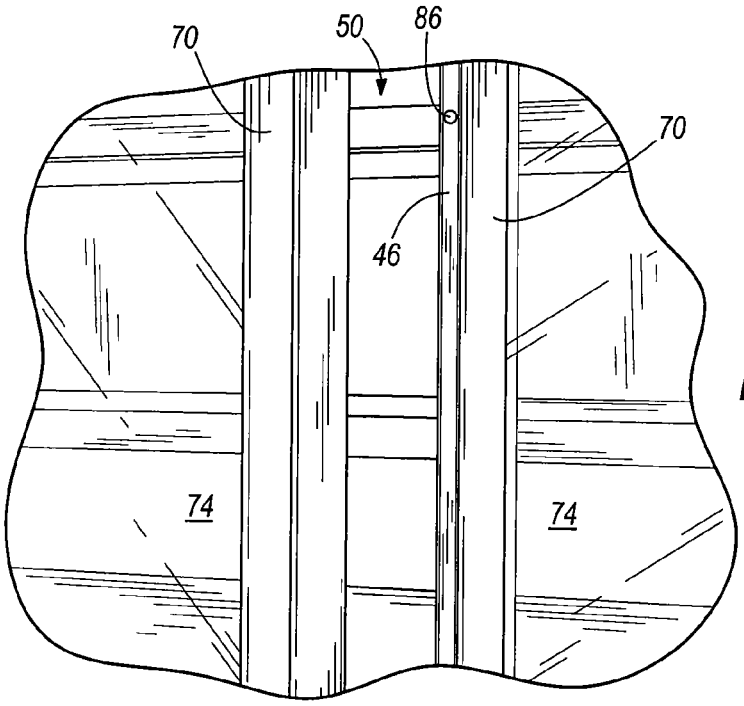
FIG. 4 is an enlarged perspective view of the refrigerated merchandiser of FIG. 1, including the sensor attached to the casing adjacent an open door.

The case 14 includes a casing 42 adjacent a front of the merchandiser 10. FIG. 2 shows that the casing 42 includes vertical mullions 46 that define openings 50 to allow access to food product stored in the product display area 34. The mullions 46 are spaced horizontally along the case 14 to provide structural support for the case 14. Each mullion 46 is defined by a structural member that can be formed from a non-metallic or metallic material. The mullions 46 are substantially hollow, and can be filled with insulating foam (not shown). In some constructions, a light assembly 54 may be attached to a surface of the mullions 46 adjacent the product display area 34 to illuminate the food product.

As illustrated in FIGS. 1 and 2, the case 14 further includes doors 58 pivotally attached to the casing 42 using upper and lower hinge assemblies 62. Each door 58 is positioned over a respective opening 50 to allow access to the food product in the product display area 34. A handle 66 is positioned along an edge of the door 58 to move the door 58 between an open position and a closed position.

Each door 58 includes a door frame 70 and a glass member 74. The door frames 70 can be formed from materials (e.g., polyurethane) that have relatively low thermal conductivity for minimizing thermal losses. In other constructions, the door frame 70 may be formed from other suitable material capable of supporting the glass member 74 (e.g., aluminum, steel, composites, etc.).

One glass member 74 is secured to each door 58 by a respective door frame 70 to allow viewing of the food product from outside the case 14. In some constructions, the glass member 74 may include three panes of glass. In other constructions, the glass member 74 may include more or fewer than three glass panes (e.g., one pane of glass, four panes of glass). Generally, multiple panes of glass are spaced apart from each other and held in generally parallel, face-to-face positions relative to each other by the door frame 70. In some constructions, one or more of the glass panes may include a low-emissivity coating.

Condensation generally forms on a surface of the glass member 74 when the temperature of the surface is lower than a dew point of air that is in contact with the surface. Condensation is a result of a combination of surface temperature and moisture in the surrounding air. Thus, condensation can form on an interior surface of the glass member 74 after the door 58 has been opened due to exposure of the generally cold interior surface to generally warm ambient conditions. Similarly, condensation can form on an exterior surface of the glass member 74 when the temperature of the exterior surface is below the dew point of the ambient air.

In the illustrated construction, an electrically conductive film or resistive coating (not shown) is adhered to the interior surface of each glass member 74. The conductive film is generally transparent to minimize interference with viewing the food product stored in the product display area 34. In some constructions, the conductive film may be adhered to the exterior surface of the glass member 74, or alternatively, to the interior surface and the exterior surface.

Figure 7:
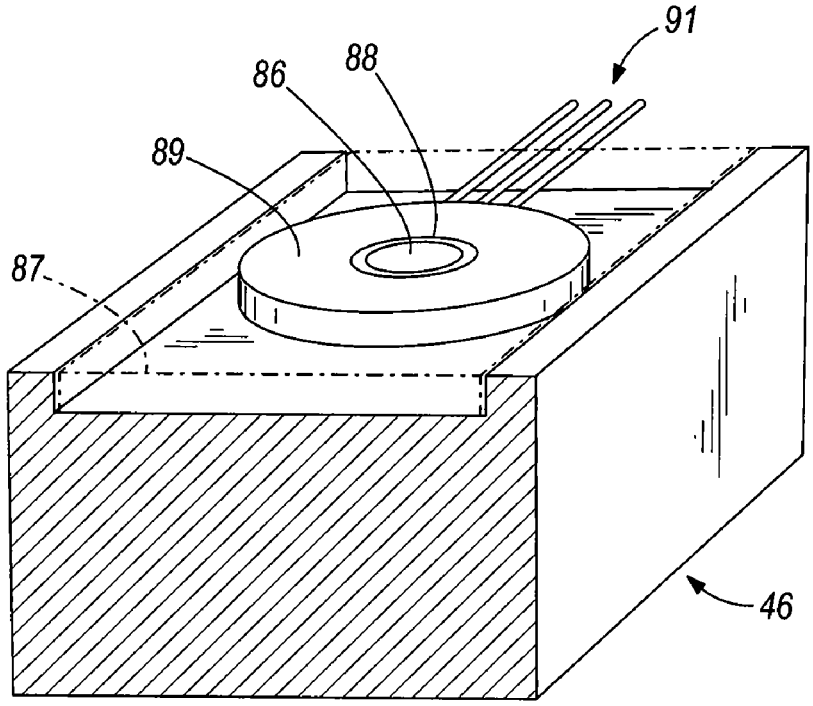
FIG. 7 is a perspective view of the sensor of FIG. 3 attached to the casing.

FIG. 1 shows that the merchandiser 10 further includes a control system that has a sensor 86 attached to each mullion 46, and a controller 90 in electrical communication with the merchandiser 10 and each sensor 86 via sensor leads 91 (FIG. 7). The sensors 86 are located on the mullions 46 so that the sensors 86 are in communication with the openings 50 to detect when one or more doors 58 are opened and closed. The sensors 86 are also in electrical communication with the controller 90 to deliver signals indicative of the door positions to the controller 90. In the construction illustrated in FIG. 7, each sensor 86 is positioned substantially within the mullions 46 behind a mullion cover 87, and is in communication with the openings 50 via a hole 88 in each mullion 46. Each hole 88 generally faces outward from the mullion 46 into the opening 50. In this construction, an insulating washer 89 can be used to secure each sensor 86 to the mullions 46. In other constructions, the sensors 86 can be adhered to a surface of the mullions 46. In still other constructions, the sensors 86 can be attached to the door frames 70 adjacent an edge of the doors 58.

In some constructions, the sensors 86 are positioned adjacent the doors 58 and in communication with ambient air to detect one or more parameters of an environment surrounding the refrigerated merchandiser 10. In these constructions, the sensors 86 are defined as environmental sensors, and can include a temperature sensing element and/or a humidity sensing element (not shown) to detect a temperature and humidity of the environment surrounding the merchandiser 10. In other constructions, the sensors 86 can sense other environment parameters. Generally, the sensors 86 indirectly sense when one or more of the doors 58 are closed based on the sensed parameter (e.g., temperature and/or humidity). The temperature and humidity of the ambient air can be sensed by the sensors 86 at a predetermined time interval (e.g., one minute, two minutes, etc.), or alternatively, the measurements can be made continuously. In some constructions, the sensors are the SHT1x and SHT7x sensors provided by SENSIRION, which are described in the attached Appendix. In other constructions, the sensor 86 may detect other ambient conditions.

In other constructions, the sensor 86 can be defined as a door switch sensor that is positioned adjacent each door 58 to detect a position of the door 58 (i.e., opened and closed). In these constructions, a different sensing device (not shown) can be coupled to the case 14 to detect various conditions of the ambient environment.

The controller 90 is in electrical communication with the conductive film through the case 14 to regulate current through the conductive film (FIG. 1) based on the signals received from the sensors 86. The current is passed through the conductive film, which heats the glass member 74 to remove condensation. The controller 90 is a microcontroller that can be attached to the merchandiser 10 in any suitable location (e.g., the base 18, on the case top 26, etc.). Alternatively, the controller 90 may be remotely located from the merchandiser 10.

Figure 5:
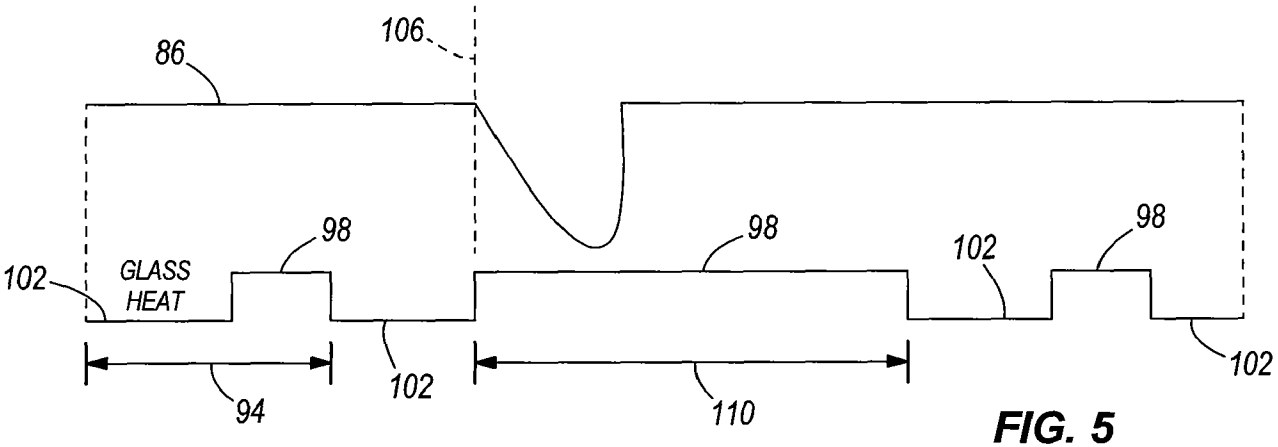
FIG. 5 is a schematic view of one embodiment of a process of the control system for determining a clearing interval for the doors.
Figure 6:
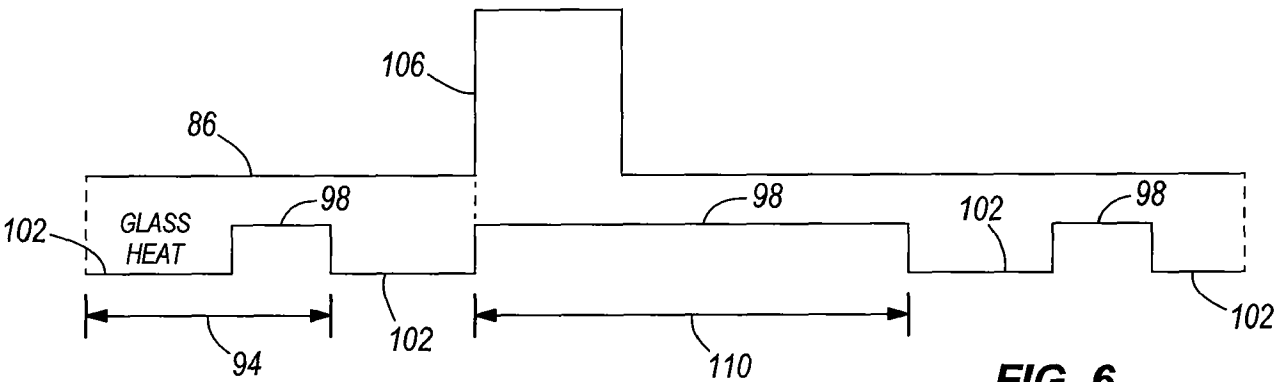
FIG. 6 is a schematic view of another embodiment of a process of the control system for determining a clearing interval for the doors.

FIGS. 5 and 6 show that the controller 90 determines a duty cycle or pulse width modulation period 94 to regulate heat applied to the glass member 74 based on the conditions of the ambient environment. In constructions that include the sensors 86 defined as environmental sensors, the signals indicative of the conditions of the ambient environment are delivered by the sensors 86 to the controller 90 to establish the duty cycle 94. In constructions that include the sensors 86 defined as door switch sensors, the additional sensing device can deliver signals indicative of the conditions of the ambient environment to the controller 90.

In some constructions, the control system can include one or more sensors 86 to detect ambient conditions of the environment, which send signals indicative of the conditions to the controller 90 for determining the duty cycle 94 for every door 58. In these constructions, the duty cycle 94 is the same for each door 58. In other constructions, the control system can include multiple sensors 86, with one sensor 86 attached to the case 14 adjacent each door 58 to independently regulate the duty cycle 94 for the respective door 58. In these constructions, the duty cycle 94 for one door 58 can be the same or different from the duty cycle 94 for the remaining doors 58 in a refrigerated merchandiser 10 that includes multiple doors 58.

The duty cycle 94 is operated by the controller 90 over a predetermined time duration (e.g., 10 minutes), and is varied by the controller 90 between an "on" state 98 and an "off" state 102 to limit energy consumption of the case 14. In some constructions, the duty cycle 94 can be varied between a first "on" state that corresponds to a first amount of electrical potential, and a second "on" state that corresponds to a second amount of electrical potential that is larger than the first amount of electrical potential. In other words, the duty cycle 94 in these constructions increases the electrical potential from a first electrical potential to a second, increased or higher electrical potential relative to the first electrical potential to remove condensation and fog from the glass member 74. After the glass member 74 is cleared, the amount of electrical potential can be decreased from the second electrical potential to the decreased or lower first electrical potential.

The predetermined time duration represents one complete duty cycle 94, i.e., the time needed for the duty cycle 94 to cycle through one "on" state 98 and one "off" 102 state. The duty cycle 94 is operated for a first predetermined time in the "on" state 98 (e.g., 4 minutes), and is operated for a second predetermined time in the "off" state 102 (e.g., 6 minutes). When the duty cycle 94 is in the "on" state 98, heat is applied to the glass member 74 through the conductive film to remove or inhibit condensation. When the duty cycle 94 is in the "off" state 102, current no longer flows through the conductive film and no heat is applied to the glass member 74.

FIGS. 5 and 6 show the duty cycle 94 beginning in the "off" state 102. In other constructions, the duty cycle 94 may begin in the "on" state 98. The controller 90 renews the duty cycle 94 in response to expiration of the predetermined time duration. The duty cycle 94 is generally defined by the percentage of time that heat is applied to the glass member 74 (i.e., the first predetermined time relative to the time period defined by one complete duty cycle 94). For example, a forty percent duty cycle 94 for a predetermined time duration of ten minutes results in the duty cycle being operated in the "off" state 102 for six minutes (i.e., the first predetermined time), and operated in the "on" state 98 for four minutes (i.e., the second predetermined time). Thus, a relatively small percentage duty cycle 94 (e.g., 10 percent) corresponds to a relatively short second predetermined time, and a relatively large percentage duty cycle 94 (e.g., 90%) corresponds to a relatively long second predetermined time.

The controller 90 operates the duty cycle 94 in the "on" state 98 for the first predetermined time to clear condensation from the glass member 74. The first predetermined time is generally a function of the temperature and humidity differential between the refrigerated product display area 34 and the ambient environment. When the differential is relatively large, a longer first predetermined time is needed to clear the condensation from the glass member 74. When the differential is relatively small, a shorter first predetermined time is adequate to remove or inhibit condensation from the glass member 74.

In operation, the control system periodically senses conditions of the environment to determine the duty cycle 94. The controller 90 receives the signals indicative of the temperature and humidity from the sensor 86, or alternatively from the sensing device. The duty cycle 94 repeats indefinitely to periodically apply heat to the glass member to inhibit condensation on the interior and exterior surfaces of the glass member 74.

Each sensor 86 delivers a signal indicative of a door event 106 to the controller 90 when one or more doors 58 are opened. In other constructions, the door event 106 may be defined by one or more doors 58 in the closed position. The controller 90 selectively initiates a clearing interval 110 in response to the signal indicative of the door event 106. The clearing interval 110 is defined by a predetermined period of time (e.g., 1 minute, 90 seconds, 2 minutes, etc.) that heat is applied to the glass member 74 to remove or inhibit condensation. In other words, the current flows through the conductive film to heat the glass member 74 when the controller 90 initiates the clearing interval 110.

In some constructions, the control system initiates the clearing interval 110 simultaneously for each door 58 of a multiple door refrigerated merchandiser 10 without regard to which door 58 experiences the door event 106. In these constructions, when a door event 106 is detected by one or more sensors 86 for a corresponding number of doors 58, the clearing interval 110 is initiated for every door 58. In other constructions, the control system can initiate the clearing interval 110 independently for each door 58 of a multiple door refrigerated merchandiser 10. In these constructions, the controller 90 separately initiates the clearing interval 110 and overrides the duty cycle 94 for each door 58 that has experienced the door event 106 independent from the remaining doors 58 that have not experienced a door event 106. The controller 90 continues to regulate condensation on the remaining doors 58 using the determined duty cycle 94.

FIG. 5 shows one embodiment of the control system that selectively initiates the clearing interval 110 based on the humidity sensed by the sensor 86. The controller 90 establishes a baseline humidity value based on signals from the sensor 86 indicative of the humidity of the ambient environment. The baseline measurements are generally determined on a rolling average of the sensed humidity over a period of time, and indicate an average of the ambient humidity that can be compared with subsequent measurements by the sensor 86. In other constructions, the control system selectively initiates the clearing interval 110 based on the temperature sensed by the sensor 86. In these constructions, the controller 90 establishes a baseline temperature value based on signals from the sensor 86 indicative of the temperature of the ambient environment. The baseline measurements are generally determined on a rolling average of the sensed temperature over a period of time, and indicate an average of the ambient temperature that can be compared with subsequent measurements by the sensor 86. In still other constructions, the control system can selectively initiate the clearing interval 110 based on the temperature and humidity sensed by the sensor 86, or alternatively, other parameters sensed by the sensor 86. Generally, the controller 90 establishes a baseline humidity value and/or temperature value based on signals from the sensor 86 indicative of the temperature and/or humidity of the ambient environment.

Placement of the sensor 86 in close proximity to the glass members 74 subjects the sensors 86 to refrigerated air when the door 58 is opened to access the food product. When the door 58 is open, the sensor 86 detects the relatively cold, dry air from the product display area 34 rather than the ambient conditions outside the case 14. The measurements of the cold, dry air by the sensor 86 are delivered to the controller 90, and are compared with the baseline measurements.

As illustrated in FIG. 5, the controller 90 determines the existence of a door event 106 based on the parameter (e.g., temperature, humidity, etc.) of the ambient environment sensed by the sensor 86. Refrigerated air flows outward from the product display area 34 when the door 58 is opened, which decreases the temperature and humidity of the air adjacent the sensors 86. In some constructions, a relatively large humidity differential results when the refrigerated air sensed by the sensor 86 is compared by the controller 90 with the baseline humidity. Similarly, a relatively large temperature differential can result when the refrigerated air sensed by the sensor 86 is compared by the controller 90 with the baseline temperature. After the relatively large humidity and/or temperature differential is determined by the controller 90, the controller 90 discards the measurements of the refrigerated air made by the sensor 86 to avoid changing the duty cycle 94 in response to the refrigerated air.

Absent a door event 106, the controller operates the duty cycle 94 without interruption by the clearing interval 110. The controller 90 determines the existence of the door event 106 based on the relatively large humidity differential and/or temperature differential caused by refrigerated airflow adjacent the sensor 86. When the door event 106 occurs, the controller 90 interrupts or overrides the duty cycle 94 and initiates the clearing interval 110 to remove or inhibit condensation on the glass member 74. As illustrated in FIG. 5, the controller 90 restarts the duty cycle 94 after the clearing interval 110 is complete (i.e., the predetermined period of time has elapsed). In other constructions, the controller 90 may restart the duty cycle 94 at the point where the duty cycle 94 was interrupted by the clearing interval 110.

FIG. 6 shows another embodiment of the control system that initiates the clearing interval 110 in response to a door event 106 based on the signal from the door switch sensor 86. The duty cycle 94 operates normally and without interruption when a door event 106 is not detected by the controller 90 (i.e., the door 58 remains closed). When the door 58 is opened, the signal indicative of the door event 106 is delivered to the controller 90 by the door switch sensor 86. As discussed with regard to FIG. 5, the controller 90 interrupts or overrides the duty cycle 94 and initiates the clearing interval 110 in response to the signal indicative of the door event 106 to remove or inhibit condensation on the glass member 74. The controller 90 restarts the duty cycle 94 after the clearing interval 110 is complete (i.e., the predetermined period of time has elapsed). In some constructions, the controller 90 may restart the duty cycle 94 at the point where the duty cycle 94 was interrupted by the clearing interval 110. In other constructions, the clearing interval 110 may be initiated in response to the closing of the door 58 as sensed by the door switch sensor 86. In still other constructions, the clearing interval 110 may be initiated after a predetermined lapse of time after the door 58 is opened or closed as detected by the sensor 86.

The control system determines the existence of the position of the doors 58 such that heat is applied to the glass members 74 immediately or very soon after the doors 58 move between open and closed positions. Initiation of the clearing interval 106 in response to door events 106 quickly removes or inhibits condensation on the glass members 74. Once the clearing interval 106 is complete, the control system returns to normal operation.

Various features and advantages of the invention are set forth in the following claims.

The invention claimed is:

1. A method of operating a refrigerated merchandiser including a case defining a product display area, and at least one door providing access to the product display area, the method comprising:

sensing a parameter of an ambient environment adjacent the case;

determining a duty cycle using a controller based on the signal indicative of the sensed parameter;

detecting an occurrence of a door event of the door in response to moving the door between a first position and a second position different from the first position;

interrupting the duty cycle by initiating a clearing interval using the controller in response to the door event; and clearing condensation from the door during the clearing interval.

2. The method of claim 1, further comprising sensing the door in the first position;

delivering a first signal indicative of the door position to a controller;

sensing the door in the second position; and delivering a second signal indicative of the door in the second position to the controller.

3. The method of claim 2, further comprising subsequently sensing the door in the first position;

determining an end of the door event in response to sensing the door in the first position; and initiating the clearing interval at the end of the door event.

4. The method of claim 2, further comprising operating the duty cycle in an "on" state for a first predetermined time;

clearing condensation from the door during the first predetermined time by applying heat to the door; and operating the duty cycle in an "off" state for a second predetermined time.

5. The method of claim 2, further comprising restarting the duty cycle after the clearing interval is complete.

6. A refrigerated merchandiser comprising:

a case defining a product display area and including a casing having at least one mullion defining an opening in communication with the product display area;

at least one door coupled to the casing to provide access to the product display area and to substantially enclose the product display area, the at least one door including a glass member having a conductive film;

at least one sensor positioned adjacent the at least one door, the sensor in communication with the opening to detect a door event of the door in response to moving the door between a first position and a second position different from the first position and to generate a signal indicative of the door event; and a controller in communication with the at least one sensor to receive a signal indicative of the door event from the sensor, the controller further in communication with the conductive film to initiate a clearing interval to clear condensation from the at least one door in response to the signal indicative of the door event, the clearing interval defined by a predetermined period of time such that the clearing interval has an "on" state during which heat is applied to the door and an "off" state during which no heat is applied to the door.

7. The refrigerated merchandiser of claim 6, wherein the sensor includes a door switch sensor, and wherein the door event includes movement of the door between an open position and a closed position.

8. The refrigerated merchandiser of claim 7, further comprising a refrigeration system coupled to the case and in communication with the product display area to deliver refrigerated air to the product display area, and wherein the sensor is in communication with the refrigerated air in response to the movement of the door from the closed position to the open position.

9. The refrigerated merchandiser of claim 6, wherein the sensor includes an environment sensor in communication with an ambient environment adjacent the case to sense one or more ambient conditions adjacent the door and to generate one or more signals indicative of the ambient conditions to the controller.

10. The refrigerated merchandiser of claim 9, wherein the door event is based on the ambient conditions sensed by the sensor.

11. The refrigerated merchandiser of claim 9, wherein the controller is programmed to determine a duty cycle having an "on" state and an "off" state based on the sensed ambient conditions, and wherein heat is applied to the glass member when the duty cycle is in the "on" state.

12. The refrigerated merchandiser of claim 11, further comprising a plurality of mullions defining a plurality of openings, wherein a door is positioned over each of the plurality of openings, and wherein the controller is programmed to independently determine a duty cycle for each door.

13. The refrigerated merchandiser of claim 6, wherein the sensor is coupled to the mullion adjacent the door.

14. The refrigerated merchandiser of claim 13, wherein the sensor is disposed in a hollow portion of the mullion, and wherein the sensor is in communication with the opening via a hole in the mullion.

* * * * *